US006505447B1

(12) United States Patent
Oliver et al.

(10) Patent No.: US 6,505,447 B1
(45) Date of Patent: Jan. 14, 2003

(54) FOUNDATION AND METHOD OF INSTALLING THE FOUNDATION COMPRISING A GROUND ENGAGING PAN, CROSS BRACES CLAMPED TO FLANGES OF A SUPPORT FRAME, AND CROSS BRACES CLAMPED TO EACH OTHER AT THE CROSSPOINTS

(76) Inventors: James Oliver, P.O. Box 9, Hohenwald, TN (US) 38462; Evon Oliver, P.O. Box 9, Hohenwald, TN (US) 38462

( * ) Notice: Subject to any disclaimer, the term of this patent is extended or adjusted under 35 U.S.C. 154(b) by 0 days.

(21) Appl. No.: 09/579,228

(22) Filed: May 30, 2000

(51) Int. Cl.[7] ..... E02D 27/48

(52) U.S. Cl. ..... 52/292; 52/695; 52/741.15; 52/DIG. 11

(58) Field of Search ..... 52/292, 299, DIG. 11, 52/632, 695, 741.15; 403/209, 213, 232.1, 234, 235

(56) References Cited

U.S. PATENT DOCUMENTS

| | | | | | |
|---|---|---|---|---|---|
| 3,750,349 | A | * | 8/1973 | Deike | 52/23 |
| 3,823,958 | A | * | 7/1974 | Trejbal | 280/150.5 |
| 4,148,162 | A | * | 4/1979 | Goodrich | 52/23 |
| 4,417,426 | A | * | 11/1983 | Meng | 52/126.7 |
| 4,562,673 | A | * | 1/1986 | Barari | 52/167 |
| 4,863,137 | A | | 9/1989 | Cockman et al. | 248/545 |
| 4,923,165 | A | | 5/1990 | Cockman | 248/545 |
| 5,697,191 | A | * | 12/1997 | MacKarvich | 52/169.9 |
| 5,784,844 | A | | 7/1998 | MacKarvich | 52/292 |
| 5,850,718 | A | | 12/1998 | MacKarvich | 52/292 |
| 5,862,635 | A | * | 1/1999 | Linse et al. | 52/126.6 |
| 5,884,874 | A | | 3/1999 | Speece et al. | 248/516 |
| 5,927,677 | A | | 7/1999 | Speece et al. | 248/516 |
| 6,058,663 | A | | 5/2000 | MacKarvich | 52/167.3 |
| 6,119,412 | A | * | 9/2000 | Jackson | 52/143 |

* cited by examiner

*Primary Examiner*—Beth A. Stephan
*Assistant Examiner*—Naoko Slack
(74) *Attorney, Agent, or Firm*—Calif Tervo

(57) ABSTRACT

A foundation for a manufactured home having first and secondelongate support beams, each beam having a lateral flange, generally includes a ground pan for spreading out the load to a larger surface area to prevent sinking into the ground and for providing an anchor against horizontal movement, a cross brace assembly for supporting first beam and providing longitudinal bracing, and a lateral brace assembly connected between ground pan and second beam for providing lateral bracing. Cross bracing assembly includes front and back crossing braces of adjustable length, each having an upper end pivotally connected to a connector attached to first beam and each having a bottom end pivotally supported by the ground pan. A U-bolt assembly connects cross braces at their cross point, thereby preventing relative angular movement there between them.

24 Claims, 2 Drawing Sheets

FIG. 2
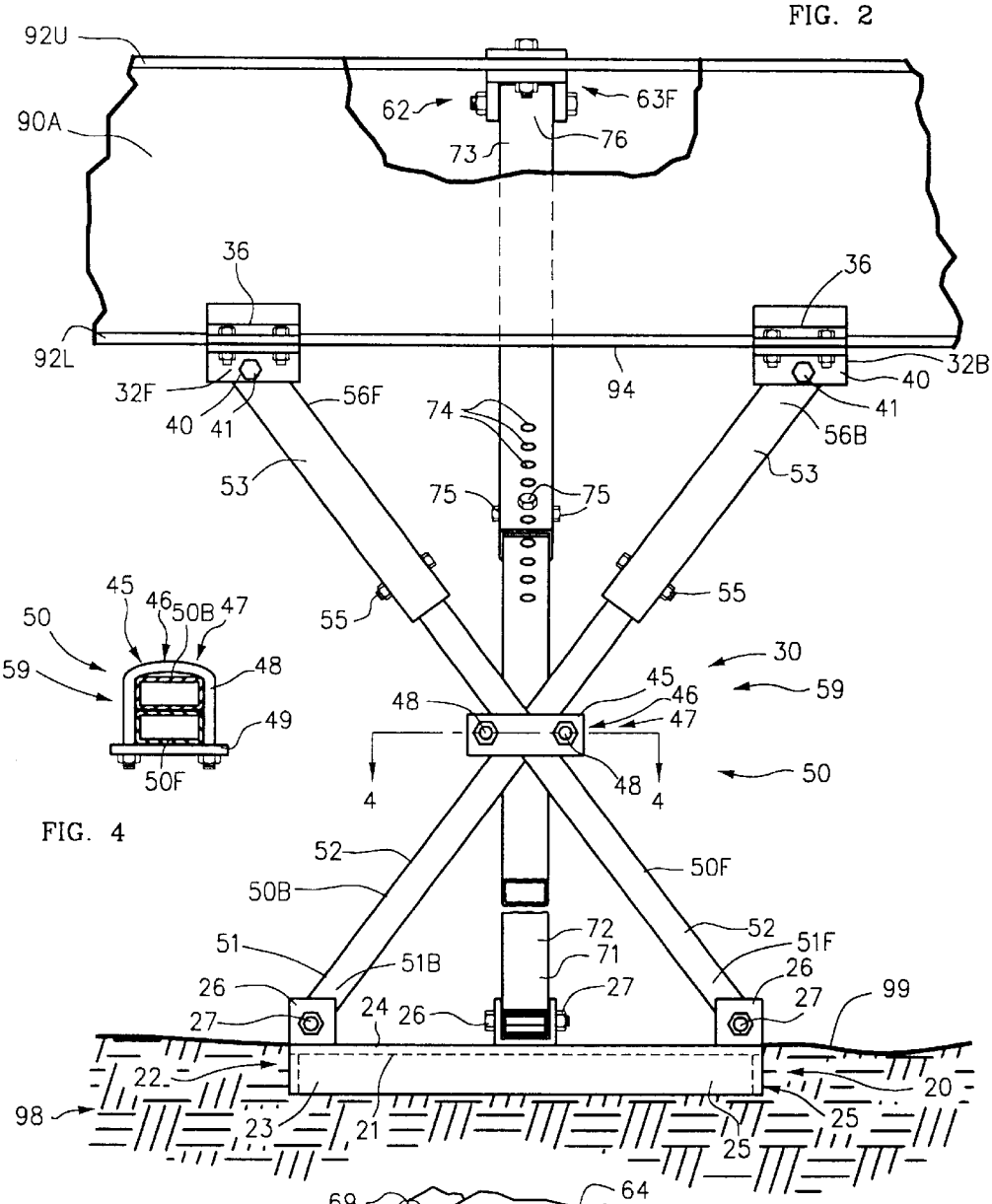
FIG. 4
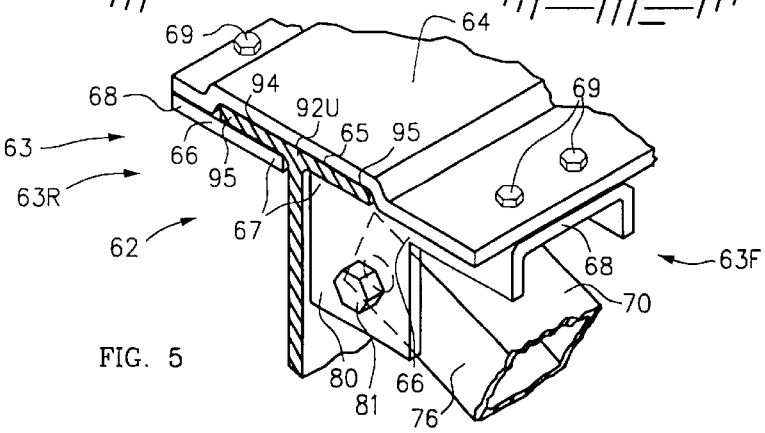
FIG. 5

FOUNDATION AND METHOD OF INSTALLING THE FOUNDATION COMPRISING A GROUND ENGAGING PAN, CROSS BRACES CLAMPED TO FLANGES OF A SUPPORT FRAME, AND CROSS BRACES CLAMPED TO EACH OTHER AT THE CROSSPOINTS

FIELD OF THE INVENTION

This invention relates to a foundation for a manufactured home, mobile home or trailer coach, and more specifically to a foundation that provides vertical support and longitudinal and lateral stability.

BACKGROUND OF THE INVENTION

Manufactured homes, mobile homes or trailer coaches include long longitudinal support beams underneath. Typically, when the home or coach is installed, a plurality of vertical piers or jacks are placed under the beams to support them. Most piers or jacks require placement on a rigid ground pad so as to not sink into the ground from the loading.

Conventional piers do not provide resistance to longitudinal forces or lateral forces that may be exerted on the coach such as by strong winds or earthquakes. Consequently, additional bracing systems must be attached to resist these longitudinal and lateral forces.

Additionally, conventional piers are relatively expensive because they need to be adjustable under load. This requires strong and well machined parts.

Since all of these devices have to be installed in the field, it is desirable that they be simple to install, preferably by a single person, not require complex tools and not require any alterations to the present beams, such as drilling, that could deleteriously affect the strength of the beams.

SUMMARY OF THE INVENTION

This invention is a foundation for a manufactured home having first and second elongate support beams, each beam having a lateral flange. The foundation generally includes a ground pan for spreading out the load to a larger surface area to prevent sinking into the ground and for providing a anchor against horizontal movement, a cross brace assembly for supporting the beam and providing longitudinal bracing, and a lateral brace assembly for providing lateral bracing.

The ground pan is disposed under the first beam and its brace assembly. The cross brace assembly includes front and back crossing braces of adjustable length, each having an upper end pivotally connected to a connector attached to the first beam and each having a bottom end pivotally supported by the ground pan. A U-bolt connects the braces at their cross point for preventing relative angular movement between them.

The lateral brace assembly includes a lateral brace of adjustable length having a top end pivotally connected to a lateral connector attached to the second beam and a bottom end pivotally connected to the ground pan.

Other features and many attendant advantages of the invention will become more apparent upon a reading of the following detailed description together with the drawings wherein like reference numerals refer to like parts throughout.

BRIEF DESCRIPTION OF THE DRAWINGS

FIG. 2 is a partially cut away, front elevation view of the foundation of FIG. 1.

FIG. 4 is a cross sectional view taken on line 4—4 of FIG. 2 showing the clamping assembly for the cross brace.

FIG. 5 is an enlarged perspective view of the lateral connector attached to the second beam.

DETAILED DESCRIPTION OF THE INVENTION

Figure 1:
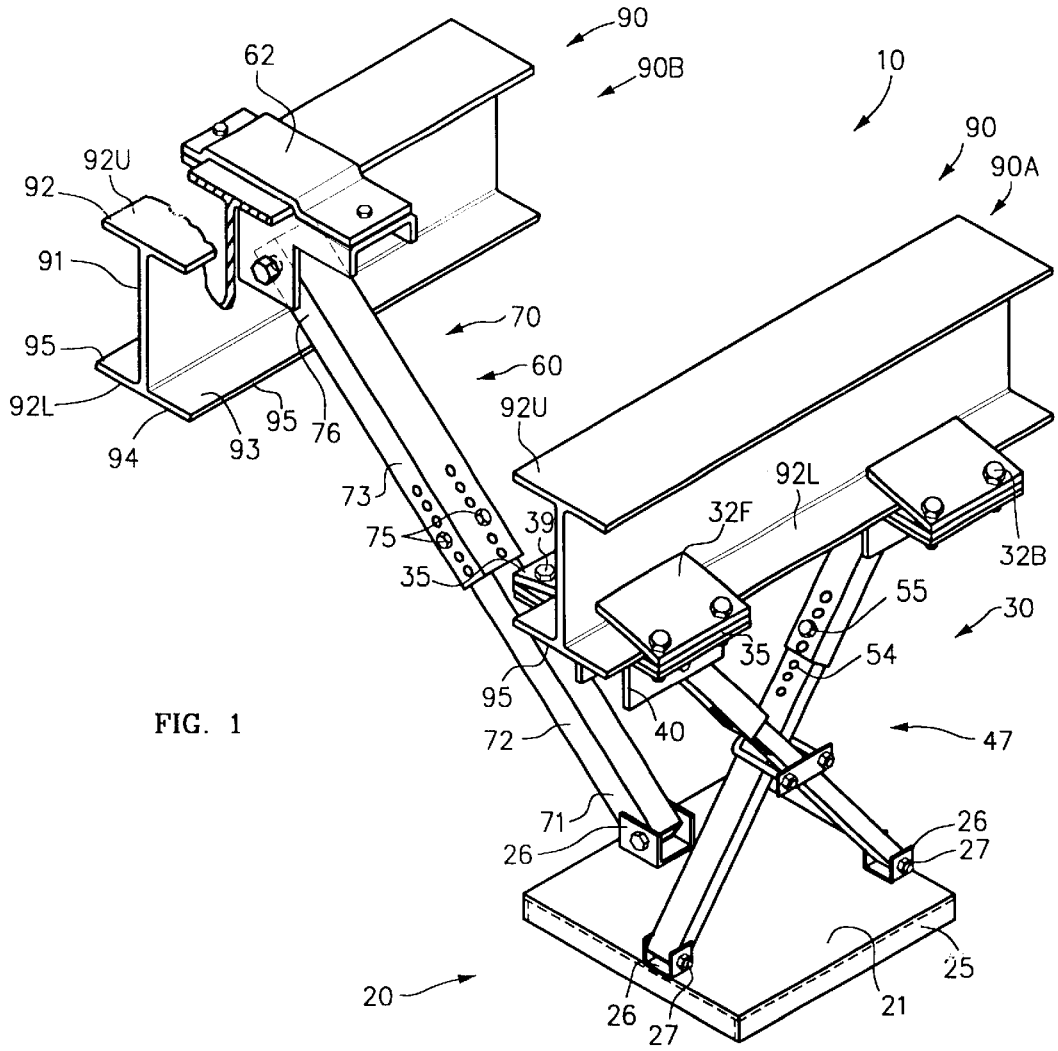
FIG. 1 is a partially cut away, perspective view of the foundation of the invention including a cross brace assembly and a lateral brace assembly attached to support beams of a manufactured home, supported by a ground pan.

With reference now to the drawings, FIG. 1 is a partially cut away, perspective view of the foundation 10 of the invention including a cross brace assembly 30 and lateral brace assembly 60 attached to support beams 90 of a manufactured home. FIG. 2 is a partially cut away, front elevation view of foundation 10 of FIG. 1. Support beams 90 includes first beam 90A and second beam 90B. Beams 90, shown, are typical I-beams made such as of steel and are elongate, horizontal and parallel. Each beam 90 includes a vertical web 91, a lateral flange 92, such as upper and lower lateral flanges 92U, 92L respectively. Each flange 92 has a top surface 93, a bottom surface 94 and a free end 95, or, with the I-beam 90 shown, has two free ends 95. Beams 90 are typically twelve inches in height and are spaced apart ninety six inches between webs 91. Although, I-beams are shown and described, it will be seen that the invention is applicable to other beams, such as C-beams, with only slight modifications.

A ground pan 20 is disposed under first beam 90A. Ground pan 20 provides support for brace assemblies 30, 60. Ground pan 20 includes a plate 21 having a downward facing lower surface 24 for bearing on grade 99 of ground 98. Plate 21 is made of strong stiff material, such as of steel or galvanized iron of twelve or greater gauge. Typical dimensions are twenty or twenty four inches square. Ground pan 20 includes anchoring means 22 attached to plate 21, such as ground insertion means 23, inserted in the ground 98, for preventing horizontal movement of pan 20. Ground insertion means 23 may be any suitable means, such as spikes, but, preferably, has a large side surface for resisting lateral forces. In the preferred embodiment shown, ground insertion means 23 includes downward blades 25 about the periphery of plate 21. Blades 25 may be part of plate 21 bent over or may be stiff angle members attached to plate 21.

Cross brace assembly 30, includes a pair of crossed braces 50, including front brace 50F and back brace 50B. Cross brace assembly 30 supports first beam 90A and resists longitudinal movement of beam 90A. A front connector 32F is attached to flange 92L of first beam 90A. A back connector 32B is attached to flange 92L of first beam 90A. An elongate, rigid, front cross brace 50F includes a bottom end 51F pivotally supported by ground pan 20 and a top end 56F pivotally attached to front connector 32F. An elongate, rigid, back cross brace 50B includes a bottom end 51B pivotally supported by ground pan 20 and a top end 56B pivotally attached to back connector 32B. Cross braces 50F, 50B cross at crossing 59.

Front cross brace 50F and back cross brace 50B are adjustable in length. Each brace 50F, 50B includes a first member, such as first elongate box tube 52 and a second member, such as second elongate box tube 53, selectively, longitudinally, slidably engaged with the first member for adjusting the length of brace 50F,50B. First tube 52 may be one and one-quarter inch square or box tube and second tube 53 may be one and one-half inch box tube that telescopically slides over the first tube 52.

Locking means between first and second tubes 52, 53, fixes their relative position and therefore fixes the length of each brace 50F, 50B. In the preferred embodiment, the locking means includes a plurality of bores 54 in each tube 52, 53 and a fastener, such as a pin or bolt 55 for passing through bores 54. Alternatively, many other suitable locking means could be used, such as self-tapping screws.

Bottom ends 51F, 51B of cross braces 50F, 50B are pivotally supported by ground pan 20. U-brackets 26 are attached by any suitable means such as by welding or bolt to pan 20. A pivot or journal bolt 27 pivotally connects bracket 26 with a bottom end 51F, 51B of a cross brace 50F, 50B such that brace 50 cannot move downward or longitudinally.

Figure 3:
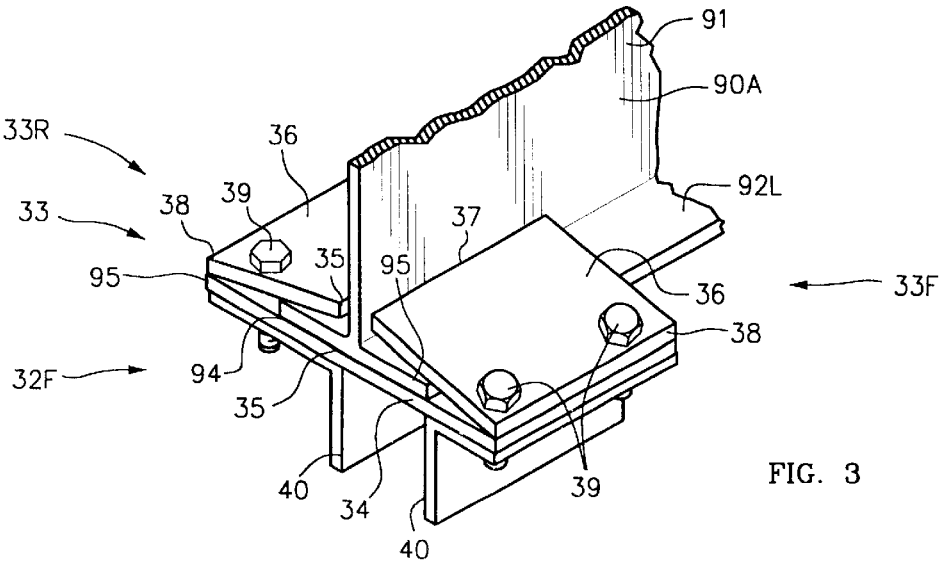
FIG. 3 is an enlarged perspective view of the front connector of FIGS. 1 and 2 attached to the first beam; the back connector being a mirror image.

FIG. 3 is an enlarged perspective view of the front connector 32F of FIGS. 1 and 2 attached to first beam; the back connector 32B being a mirror image. Front connector 32F includes clamping means 33, such as front clamping means 33F and rear clamping means 33R, for clamping front connector 32F to each free end 95 of flange 92L. A common bottom plate 34, having an upper surface 35 for bearing on the bottom surface 94 of flange 92L, may be used by both clamping means 33F, 33R. Each clamping means 33F, 33R includes a top plate 36, having a first end 37 for disposition above flange 92L and a second end 38 in contact with bottom plate 34. Adjustable connecting means, such as a bolts 39, connect top plate 36 and bottom plate 34 so as to clamp flange 92L therebetween. A U-bracket 40 is attached to bottom plate 34 by any suitable means, such as bolts 39. A pivot or journal bolt 41 pivotally connects bracket 40 with top end 56F of front cross brace 50F.

Back connector 32B is mirror image of front connector 32F and is obtained by rotating front connector 32F 180°.

FIG. 4 is a cross sectional view taken on line 4—4 of FIG. 2 showing clamping assembly 46 for cross braces 50 at cross point 59. Fastening means 45, such as external clamping assembly 46, such as U-bolt assembly 47, comprising a U-bolt 48 and plate 49, connects front cross brace 50F to back cross brace 50B at cross point 59 for preventing relative angular movement between braces 50F, 50B. Fastening means 45 stabilizes and adds support strength to cross braces 50 and provides additional support to maintaining braces 50 in their clamped position supporting first beam 90A.

FIG. 5 is a perspective view of lateral connector 62 of lateral brace assembly 60 attached to second beam 90B. Lateral brace assembly 60 provides resistance to lateral loads, such as encountered from wind or earthquake. Lateral brace assembly 60 generally includes lateral connector 62 and lateral brace 70. Lateral brace 70 is an elongate, rigid member having a bottom end 71 pivotally supported by ground pan 20 and a top end 76 pivotally attached to lateral connector 62.

Brace 70 is adjustable in length and includes a first member, such as first elongate box tube 72 and a second member, such as second elongate box tube 73, selectively, longitudinally, slidably engaged with the first member for adjusting the length of brace 70. First tube 72 may be one and one-quarter inch square or box tube and second tube 73 may be one and one-half inch box tube that telescopically slides over the first tube 72. Locking means between first and second tubes 72, 73, fixes their relative position and therefore fixes the length of brace 70. In the preferred embodiment, the locking means includes a plurality of bores 74 in outer or second tube 73. One or more fastener, such as self-tapping screws are placed in bores 74 and attached to inner or first tube 72.

Bottom end 71 of lateral brace 70 is pivotally supported by ground pan 20. U-bracket 26 attached by any suitable means such as by welding or a bolt to pan 20. A pivot or journal bolt 27 pivotally connects bracket 26 with bottom end 71 of a brace 70.

Lateral connector 62 clamps on a flange 92, such as on upper lateral flange 92U, of second beam 90B. Lateral connector 62 includes clamping means 63, such as front clamping means 63F and rear clamping means 63R, for clamping connector 62 to each free end 95 of flange 92U. A common top plate 64, having a lower surface 65 for bearing on top surface 94 of flange 92U, may be used by both clamping means 63F, 63R. Each clamping means 63F, 63R includes a plate 66, having a first end 67 for disposition below flange 92U and a second end 68 in contact with top plate 64. Adjustable connecting means, such as a bolts 69, connect top plate 64 and plates 66 so as to clamp flange 92U therebetween. A U-bracket 80 is attached to a bottom plate 66 by any suitable means, such as bolts 69. A pivot or journal bolt 81 pivotally connects bracket 80 with top end 76 of brace 70.

Only one adjustable jack or pier is used to install a plurality of foundations 10 as needed. In use, pad 20 is placed under beam 90A with ground pan U-brackets 26 for cross brace connectors 32F, 32B directly under beam 90A. Pan blades 23 are inserted into the ground 98, such as by pushing by hand or tapping with a weight or hammer. An adjustable jack or pier is used to temporarily support beam 90A near pad 20. Cross brace assembly 30 is attached to pad 20, adjusted to length so that braces 50 are at a rise angle of about 40–66 degrees, and clamped to beam 90A. The U-bolt is tightened. The temporary jack is removed. Cross brace assembly 30 now supports beam 90A and pushes down on pad 20. Lateral brace assembly 60 is attached to pan 20 and second beam 90B. Self-tapping screws 75 are screwed in lateral brace bores 74 to fix its length.

Having described the invention, it can be seen that it provides a very convenient foundation for supporting a manufactured home while simultaneously providing resistance to longitudinal and lateral forces on the home. Foundation 10 is easy to set up in the field with a minimum of tools and personnel, i.e. one person with a wrench and screw driver. The multi-functionality of ground pan 20 and cross brace assembly 30 replaces a pier and separate braces. Foundation 10 replaces a former expensive adjustable pier and longitudinal braces and provides a platform for a lateral brace.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A foundation providing vertical support and longitudinal stability for a manufactured home having an elongate, horizontal support beam having a lateral flange having a top surface, a bottom surface and a free edge; said foundation comprising:

a ground pan disposed under the beam; said ground pan including means engaged with the ground for preventing horizontal movement of said ground pan;

a front connector including:

clamping means for clamping said front connector to the flange;

a back connector including:

clamping means for clamping said back connector to the flange;

an elongate, rigid, front cross brace including:

a bottom end pivotally supported by said ground pan; and a top end pivotally attached to said front connector;

an elongate, rigid, back cross brace including:

a bottom end pivotally supported by said ground pan; and a top end pivotally attached to said back connector; said cross braces having a cross point; and an external clamping assembly clamping together said front cross brace to said back cross brace at said cross point for preventing relative vertical angular movement between said front cross brace and said back cross brace.

2. The foundation of claim 1 wherein:

said clamping assembly is a U-bolt and plate.

3. The foundation of claim 1, said front cross brace further including:

a first member; and a second member selectively, longitudinally, slidably engaged with said first member of said front cross brace for adjusting the length of said front cross brace; and further including means interacting with said first and second members of said front cross brace for fixing the length of said front cross brace.

4. The foundation of claim 1 wherein:

said front connector clamping means includes:

a bottom plate having an upper surface for bearing on the bottom surface of the flange;

a top plate having a first end for disposition above the flange; and means connecting said front connector plates for clamping said front connector plates on the flange therebetween; and said back connector clamping means incudes:

a bottom plate having an upper surface for bearing on the bottom surface of the flange;

a top plate having a first end for disposition above the flange; and means connecting said back connector plates for clamping said plates to the flange therebetween.

5. The foundation of claim 1, said back cross brace further including:

a first member; and a second member selectively, longitudinally, slidably engaged with said first member of said back cross brace for adjusting the length of said back cross brace; and further including means interacting with said first and second members of said back cross brace for fixing the length of said back cross brace.

6. The foundation of claim 1; said front cross brace further including:

a first member; and a second member selectively, longitudinally, slidably engaged with said first member of said front cross brace for adjusting the length of said front cross brace; and further including means interacting with said first and second members of said front cross brace for fixing the length of said front cross brace.

7. A foundation providing vertical support and longitudinal stability for a manufactured home having first and second elongate, horizontal, parallel, support beams; the first beam having a lateral flange; the second beam having a lateral flange; said foundation comprising:

a ground pan disposed under the first beam; said ground pan including means engaged with the ground for preventing horizontal movement of said ground pan;

a cross brace assembly including:

a front connector including:

clamping means for clamping said front connector to the flange of the first beam;

a back connector including:

clamping means for clamping said back connector to the flange of the first beam;

an elongate, rigid, front cross brace including:

a bottom end pivotally supported by said ground pan; and a top end pivotally attached to said front connector;

an elongate, rigid, back cross brace including:

a bottom end pivotally supported by said ground pan; and a top end pivotally attached to said back connector; said cross braces having a cross point;

an external clamping assembly clamping together said front cross brace to said back cross brace at said cross point for preventing relative angular movement between said front cross brace and said back cross brace; and a lateral brace assembly including:

a lateral connector including:

clamping means for clamping said lateral connector to the flange of the second beam;

an elongate, rigid, lateral brace including:

a bottom end pivotally supported by said ground pan; and a top end pivotally attached to said lateral connector.

8. The foundation of claim 7 wherein:

said clamping assembly is a U-bolt and plate.

9. The foundation of claim 7, said front cross brace further including:

a first member; and a second member selectively, longitudinally, slidably engaged with said first member of said front cross brace for adjusting the length of said front cross brace; and further including means interacting with said first and second members of said front cross brace for fixing the length of said front cross brace.

10. The foundation of claim 7, said back cross brace further including a first member; and a second member selectively, longitudinally, slidably engaged with said first member of said back cross brace for adjusting the length of said back cross brace; and further including means interacting with said first and second members of said back cross brace for fixing the length of said back cross brace.

11. The foundation of claim 10, said front cross brace further including:

a first member; and a second member selectively, longitudinally, slidably engaged with said first member of said front cross brace for adjusting the length of said front cross brace; and further including means interacting with said first and second members of said front cross brace for fixing the length of said front cross brace.

12. A method of providing vertical support and longitudinal stability for a manufactured home having an elongate, horizontal support beam having a lateral flange having a top surface, a bottom surface and a free edge; said method comprising:

providing a foundation comprising: a ground pan including means for engaging with the ground for preventing horizontal movement of the ground pan; a front connector including: clamping means for clamping the front connector to the flange; a back connector including: clamping means for clamping the back connector to the flange; an elongate, rigid, front cross brace including: a bottom end pivotally supported by the ground pan; and a top end pivotally attached to the front connector; an elongate, rigid, back cross brace including: a bottom end pivotally supported by the ground pan; and a top end pivotally attached to the back connector; the cross braces having a cross point; and an external clamping assembly for clamping together the front cross brace to the back cross brace at the cross point for preventing relative vertical angular movement between the front cross brace and the back cross brace; positioning the ground pan under the beam;

clamping the front connector to the flange with the clamping means of the front connector;

clamping the back connector to the flange with the clamping means of the back connector such that the braces cross at a cross point; and clamping the front cross brace to the rear cross brace at the cross point with the external clamping assembly so as to prevent relative vertical angular movement between the front cross brace and the back cross brace.

13. A foundation providing vertical support and longitudinal stability for a manufactured home having an elongate, horizontal support beam having a lateral flange having a top surface, a bottom surface and a free edge; said foundation comprising:

a ground support disposed under the beam and engaged with the ground for preventing horizontal movement of said ground support;

a front connector including:

clamping means for clamping said front connector to the flange;

a back connector including:

clamping means for clamping said back connector to the flange;

an elongate, rigid, front cross brace including:

a bottom end pivotally supported by said ground support; and a top end pivotally attached to said front connector;

an elongate, rigid, back cross brace including:

a bottom end pivotally supported by said ground support; and a top end pivotally attached to said back connector; said cross braces having a cross point; and an external clamping assembly clamping together said front cross brace to said back cross brace at said cross point for preventing relative vertical angular movement between said front cross brace and said back cross brace.

14. The foundation of claim 13 wherein:

said clamping assembly is a U-bolt and plate.

15. The foundation of claim 13, said front cross brace further including:

a first member; and a second member selectively, longitudinally, slidably engaged with said first member of said front cross brace for adjusting the length of said front cross brace; and further including means interacting with said first and second members of said front cross brace for fixing the length of said front cross brace.

16. The foundation of claim 13 wherein:

said front connector clamping means includes:

a bottom plate having an upper surface for bearing on the bottom surface of the flange;

a top plate having a first end for disposition above the flange; and means connecting said front connector plates for clamping said front connector plates on the flange therebetween; and said back connector clamping means includes:

a bottom plate having an upper surface for bearing on the bottom surface of the flange;

a top plate having a first end for disposition above the flange; and means connecting said back connector plates for clamping said plates to the flange therebetween.

17. The foundation of claim 13, said back cross brace further including:

a first member; and a second member selectively, longitudinally, slidably engaged with said first member of said back cross brace for adjusting the length of said back cross brace; and further including means interacting with said first and second members of said back cross brace for fixing the length of said back cross brace.

18. The foundation of claim 17; said front cross brace further including:

a first member; and a second member selectively, longitudinally, slidably engaged with said first member of said front cross brace for adjusting the length of said front cross brace; and further including means interacting with said first and second members of said front cross brace for fixing the length of said back cross brace.

19. A foundation providing vertical support and longitudinal stability for a manufactured home having first and second elongate, horizontal, parallel, support beams; the first beam having a lateral flange; the second beam having a lateral flange; said foundation comprising:

a ground support disposed under the first beam and engaged with the ground for preventing horizontal movement of said ground support;

a cross brace assembly including:

a front connector including:

clamping means for clamping said front connector to the flange of the first beam;

a back connector including:

clamping means for clamping said back connector to the flange of the first beam;

an elongate, rigid, front cross brace including:

a bottom end pivotally supported by said ground support; and a top end pivotally attached to said front connector;

an elongate, rigid, back cross brace including:

a bottom end pivotally supported by said ground support; and a top end pivotally attached to said back connector; said cross braces having a cross point;

an external clamping assembly clamping together said front cross brace to said back cross brace at said cross point for preventing relative angular movement between said front cross brace and said back cross brace; and a lateral brace assembly including:

a lateral connector including:

clamping means for clamping said lateral connector to the flange of the second beam;

an elongate, rigid, lateral brace including:

a bottom end pivotally supported by said ground support; and a top end pivotally attached to said lateral connector.

20. The foundation of claim 19 wherein:

said clamping assembly is a U-bolt and plate.

21. The foundation of claim 19, said front cross brace further including:

a first member; and a second member selectively, longitudinally, slidably engaged with said first member of said front cross brace for adjusting the length of said front cross brace; and further including means interacting with said first and second members of said front cross brace for fixing the length of said front cross brace.

22. The foundation of claim 19, said back cross brace further including:

a first member; and a second member selectively, longitudinally, slidably engaged with said first member of said back brace for adjusting the length of said back cross brace; and further including means interacting with said first and second members of said back cross brace for fixing the length of said back cross brace.

23. The foundation of claim 22, said front cross brace further including:

a first member; and a second member selectively, longitudinally, slidably engaged with said first member of said front cross brace for adjusting the length of said front cross brace; and further including means interacting with said first and second members of said front cross brace for fixing the length of said front cross brace.

24. A method of providing vertical support and longitudinal stability for a manufactured home having an elongate, horizontal support beam having a lateral flange having a top surface, a bottom surface and a free edge; said method comprising:

providing, under the beam, a foundation comprising: a ground support engaged with the ground for preventing horizontal movement of the ground support; and front connector including:

clamping means for clamping the front connector to the flange; a back connector including:

clamping means for clamping the back connector to the flange, an elongate, rigid, front cross brace including: a bottom end pivotally supported by the ground support; and a top end pivotally attached to the front connector; an elongate, rigid, back cross brace including: a bottom end pivotally supported by the ground support; and a top end pivotally attached to the back connector, the cross braces having a cross point; and an external clamping assembly for clamping together the front cross brace to the back cross brace at the cross point for preventing relative vertical angular movement between the front cross brace and the back cross brace;

clamping the front connector to the flange with the clamping means of the front connector;

clamping the back connector to the flange with the clamping means of the back connector such that the braces cross at a cross point; and clamping the front cross brace to the rear cross brace at the cross point with the external clamping assembly so as to prevent relative vertical angular movement between the front cross brace and the back cross brace.

* * * * *